United States Patent [19]

Zust

[11] Patent Number: 4,505,304

[45] Date of Patent: Mar. 19, 1985

[54] WEFT CUTTING DEVICE FOR A LOOM

[76] Inventor: John E. Zust, Rt. 1, Seay Rd., Spartanburg, S.C. 29302

[21] Appl. No.: 471,799

[22] Filed: Mar. 3, 1983

[51] Int. Cl.[3] ..... D03D 49/70

[52] U.S. Cl. ..... 139/302; 83/658

[58] Field of Search ..... 139/302, 303, 291 C, 139/263–268; 83/658; 26/10.4

[56] References Cited

U.S. PATENT DOCUMENTS

| | | | |
|---|---|---|---|
| 3,321,145 | 5/1967 | Gorman | 83/658 X |
| 3,461,920 | 8/1969 | Sakamoto | 139/302 |
| 3,837,252 | 9/1974 | Brassel | 83/658 |
| 4,387,744 | 6/1983 | Newcomb | 139/302 X |

FOREIGN PATENT DOCUMENTS

| | | | |
|---|---|---|---|
| 2407074 | 8/1974 | Fed. Rep. of Germany | 139/302 |
| 2515228 | 11/1975 | Fed. Rep. of Germany | 139/302 |
| 203613 | 10/1967 | U.S.S.R. | 139/291 C |

*Primary Examiner*—James Kee Chi

*Attorney, Agent, or Firm*—Cort Flint

[57] ABSTRACT

A weft cutting device designated generally as (A) is disclosed for cutting a waste tape from the selvage of fabric being woven on a shuttleless loom. The cutting device includes a base (10) which pivotably carries a pivoting mechanism (24) having a cantilevered arm (28) in engagement with a protective cover (30) of a reed (32). As the reed oscillates back and forth during beat-up of the fabric on the loom, the arm is reciprocated. A blade carrier assembly (34) is attached to the pivoting arm mechanism and includes a blade holding means (38) which holds a square cutting element (B). The cutting element is four-sided and includes four cutting edges (62). An identical cutting element (B′) provides a complementary cutting surface (55) against which the blade element strikes during cutting. The blade elements (B) and (B′) are interchangeable with each other such that eight cutting edges are provided. A trapezoidal cross-section insures that the cutting elements are secuted in various clamping grooves having a dovetail configuration.

16 Claims, 6 Drawing Figures

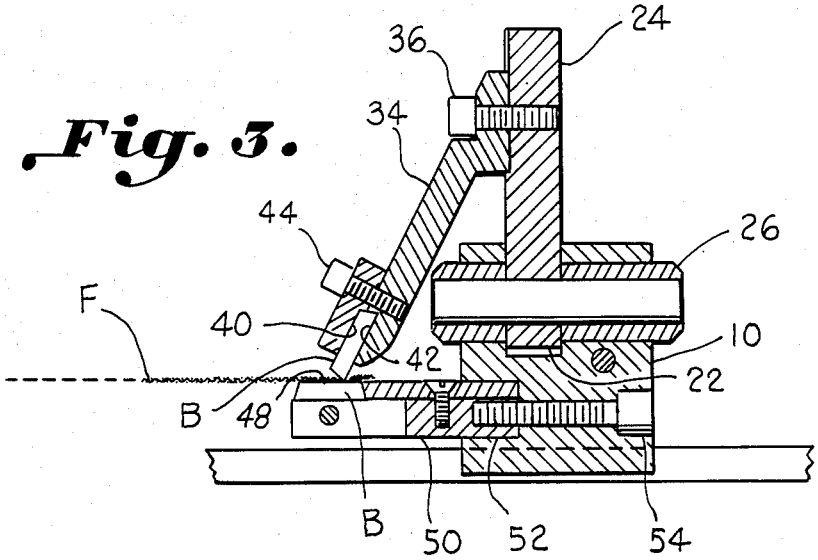
Fig. 3.
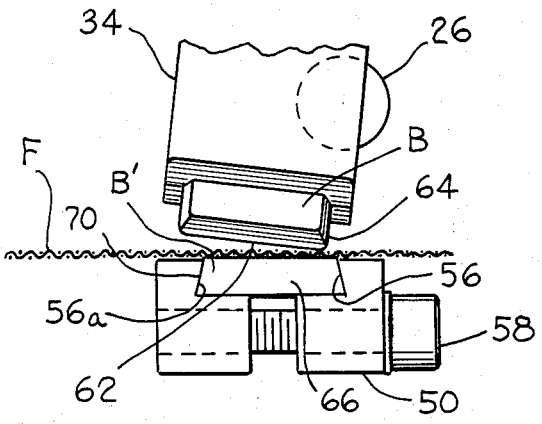
Fig. 4-A.
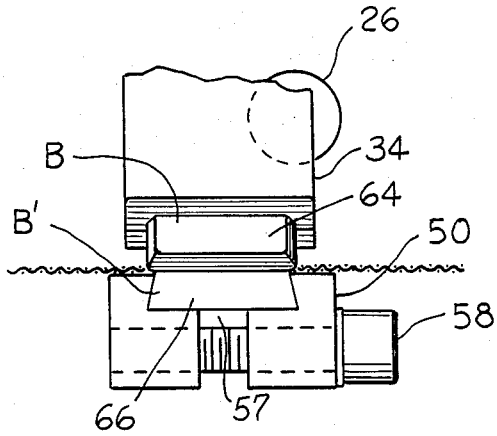
Fig. 4-B.
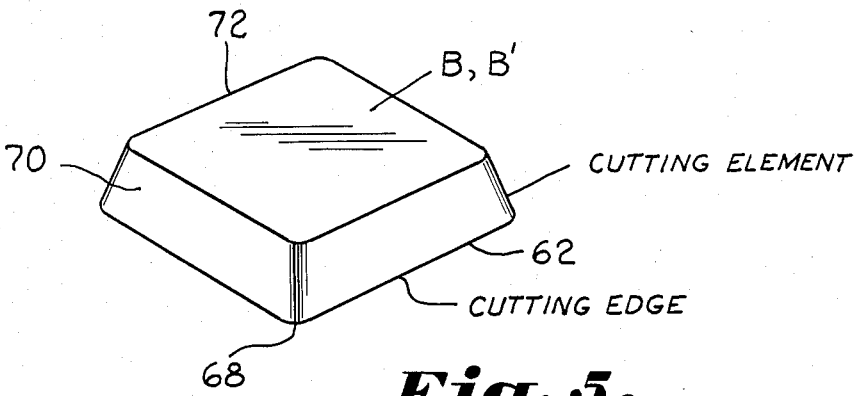
Fig. 5.

WEFT CUTTING DEVICE FOR A LOOM

BACKGROUND OF THE INVENTION

A weft cutting device is disclosed for a shuttleless weaving loom. In the weaving of fabric on a shuttleless loom, one side of the fabric opposite the weft insertion device includes extra warp yarn ends which hold the end of the weft yarn during each pick. These extra warp yarn ends form a woven tape at the selvage of the fabric which is cut off as waste during weaving.

Heretofore, various devices have been proposed for cutting the waste tape from the fabric as it is woven on the loom. Typically, these devices have utilized a pivotal arm which is pivoted by a loom reed during beat-up of the fabric on the loom. The cutting blades have mainly been provided in the form of scissor-like blades. When considering the great lengths of fabric woven on the loom, it can easily be seen that conventional type cutting blades would wear out very quickly. In the past, various materials and coatings such as carbide and teflon have been utilized to extend the cutting life of the blades of the cutting device.

Furthermore, there are many different types of fabrics woven on the looms, some of which are more difficult to cut than others. In particular, fiberglass fabric woven on a loom presents a problem of cutting which needs considerable more attention than that of regular fabric owing to the nature of the fiberglass yarns and their dulling affect on cutting edges.

SUMMARY OF THE INVENTION

Accordingly, an important object of the present invention is to provide a weft yarn cutting device for a loom having improved cutting life and versatility.

Still another important object of the present invention is to provide a weft yarn cutting device for a loom which can be utilized to cut the waste tape of heavy fabrics being woven on a loom such as fiberglass.

Still another important object of the present invention is to provide a weft yarn cutting device for cutting fiberglass and like heavy fabrics on a loom which cuts in a positive chopping action.

Still another important object of the present invention is to provide a weft yarn cutting device for cutting the waste tape from fabric woven on a shuttleless loom having a cutting blade element which includes a plurality of cutting edges which may be selectively positioned for cutting so that the cutting life of the device is greatly extended.

It has been found according to the present invention that a weft yarn cutting device can be provided which has extended cutting life and also can be advantageously used to cut heavy fabrics such as fiberglass on a loom. The device includes a clamp mount for mounting the device to a mounting bar of the loom. A reciprocating pivoting arm rides on a top surface of a beat-up reed on the loom. A blade carrier assembly is affixed to the reciprocating arm and includes a blade in which a cutting blade element may be held. A short chopping action is imparted to the blade element through the pivoting movement of the arm during oscillations of the reed beating-up the fabric. A cutting support is carried by the device beneath the blade carrier of the pivoting arm. The selvage of the fabric travels over the cutting base between the support and the cutting blade element. The cutting support includes a cutting counterpart having a complementary cutting surface which the cutting blade strikes as the fabric passes therebetween for cutting. The cutting blade element includes a straight cutting edge having rounded corners which is moved in a short arcuate motion during reciprocation of the pivoting arm to chop the fabric therebeneath. In an advantageous form of the invention the blade element is provided by a generally square carbide insert having four congruent cutting edges and converging sides tapering up to a top surface. The four edges may be individually selected and held by the carrier assembly in a cutting position. The cutting counterpart includes an identical blade element whose top surface provides the complementary cutting surface. The cutting support includes a dovetail groove in which a counterpart cutting element is received. The cutting counterpart and cutting blade element may be interchanged with one another such that eight cutting edges are provided.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 3 is a sectional view taken along line 3—3 of FIG. 2;

FIG. 4A is an elevation illustrating a cutting blade element and cutting counterpart having a complementary cutting surface with the blade element in an up position;

FIG. 4B is an illustration of the weft yarn cutting element of FIG. 4A with the blade element in a cutting position corresponding to a fabric beat-up position of a reed on the loom; and FIG. 5 is a perspective view of a cutting blade element for a cutting device constructed according to the present invention.

DESCRIPTION OF A PREFERRED EMBODIMENT

Figure 2:
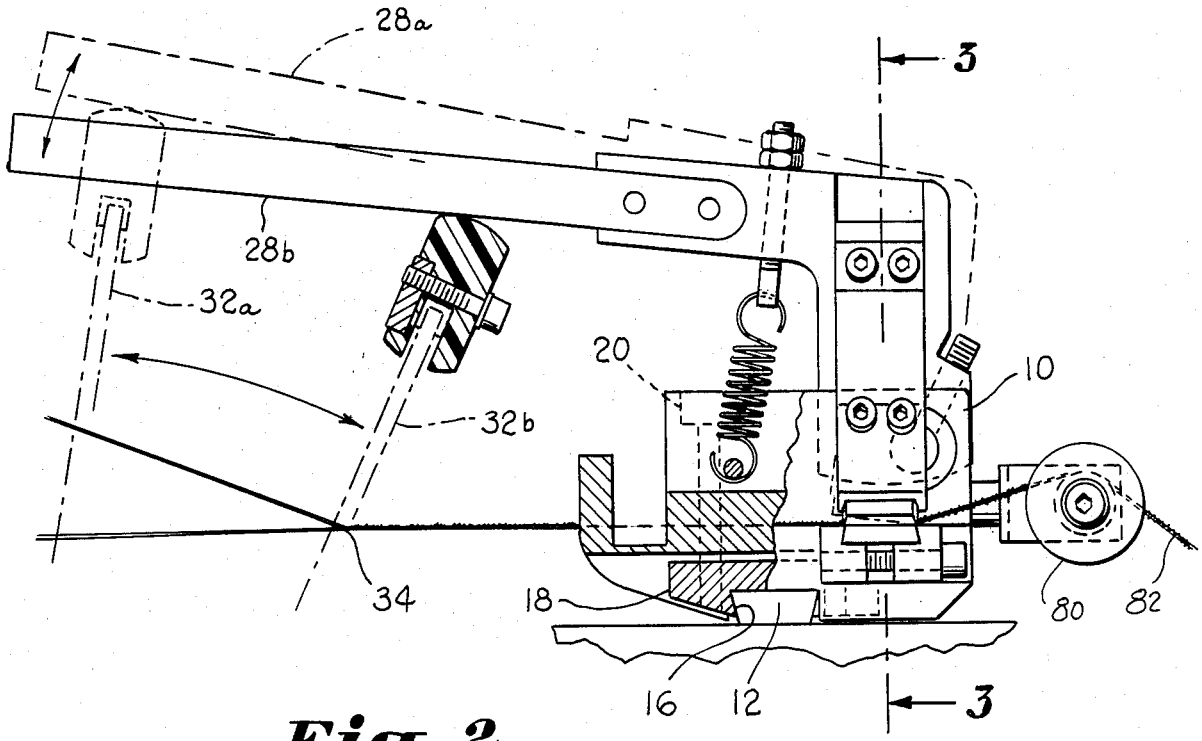
FIG. 2 is an elevation with parts in section illustrating a weft yarn cutting device constructed according to the present invention.
Figure 1:
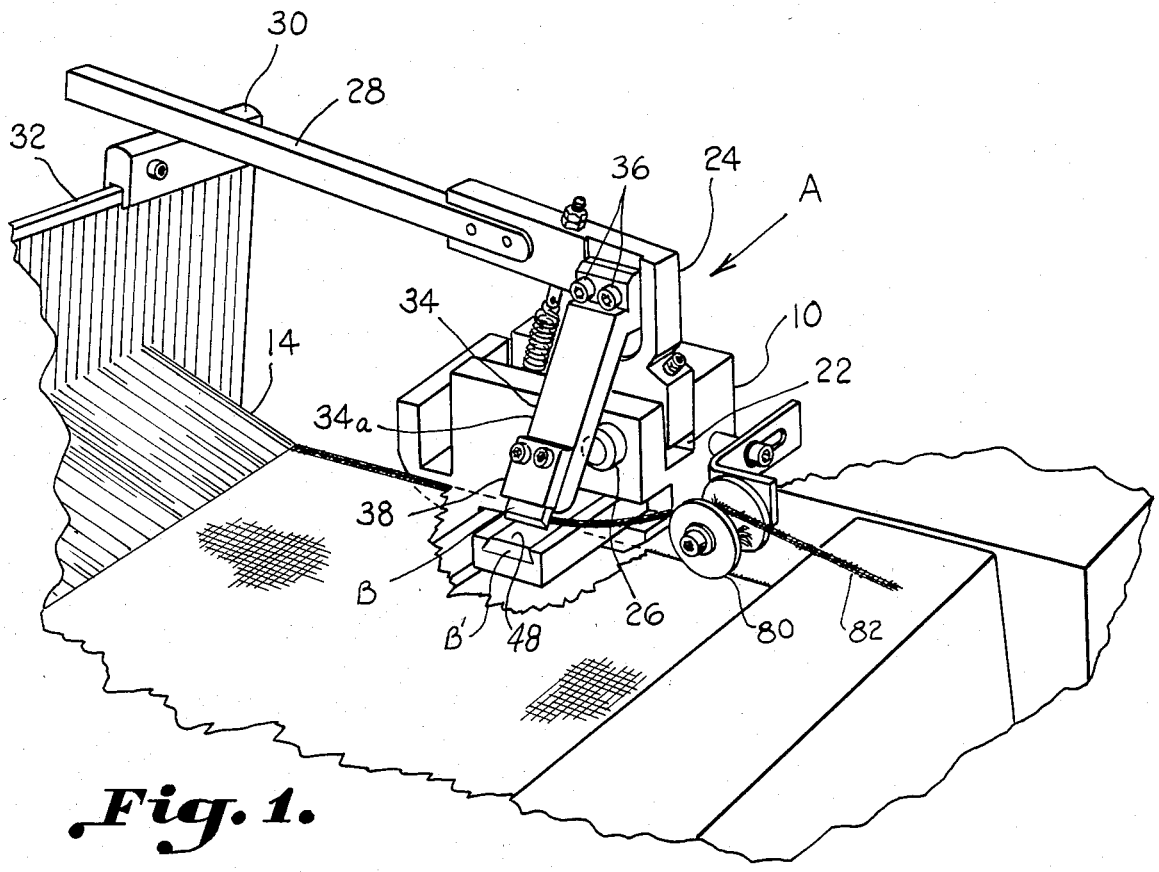
FIG. 1 is a perspective view illustrating a weft yarn cutting device for cutting the waste tape along the selvage of a fabric woven on a shuttleless weaving loom.

The drawings illustrate a weft yarn cutting device for cutting a waste tape of woven fabric from the selvage during weaving.

In a typical shuttleless weaving loom, the side of the fabric opposite the weft insertion device includes an extra number of warp yarn ends coming from a side creel which are woven with the ends of the weft yarn picks to hold the ends of the picks. After the fabric is woven and after beat-up of the fabric, it is desirable to cut the extra warp yarn ends woven with the weft yarn picks and convey the same away as waste tape.

Referring in more detail to the drawings, a weft yarn cutting device, denoted generally as A, is illustrated which includes a base means in the form of a block 10 which is mounted to a mounting bar 12 of the loom adjacent a selvage 14 of the fabric which is to be cut away. There is provided an inverted dovetail slot 16 which receives the mounting bar 12 which is in the shape of an inverted trapezoidal bar. The slot 16 is formed in a clamping block 18 which provides a clamping means for mounting device A to the loom. There is a pair of clamp screws 20 spaced equidistantly on either side of the slot 16. The screws 20 are threadably received in the block 18. The clamping block 18 may be loosely slid upon the mounting bar 12. Thereafter, the screws 20 may be tightened at the same time to draw the slot 16 tightly upon the tapering edges of the bar 12. By providing a pair of screws 20 equidistantly spaced on either side of the clamping bar 12, the tendency of the cutting device to rock about the bar is reduced. The advantage of this clamping means while the cutting device is undergoing continuous rapid reciprocating operation will become readily apparent.

The base means 10 includes a slot 22 open at the top for receiving a pivoting arm mechanism 24. A pivot pin 26 is fixed in the base block about which the arm mechanism 24 pivots or rocks in a reciprocating motion. Arm mechanism 24 includes a cantilvered arm 28 which engages a protective cap 30 which is made to fit the top of a reed 32 carried on the loom for beat-up of the fabric at the fell 34 of the fabric being woven.

As can best be seen in FIG. 2, the reed 32 oscillates between a position 32*a* and 32*b*. At 32*a* the reed is at a back position in which the arm 28 is in a raised position 28*a*. Upon the forward movement of the reed to the beat-up position at 32*b*, the arm 28 drops to a cutting position 28*b* in which the fabric is cut by the cutting device A.

A blade carrier assembly is provided at 34 which is affixed by means of screws 36 to the pivoting arm mechanism 24. There is a blade carrier shaft 34*a* which has a blade holding means in the form of a blade clamp 38 affixed to its free end. The blade includes complementary blade fitting recesses 40 and 42 formed in the blade clamp and blade carrier shaft as can best be seen in FIG. 3. The recesses correspond to the shape of a cutting blade element B, to be more fully disclosed herein, which is held by the blade holding means. There is a clamping screw 44 provided for tightening the clamp and blade carrier shaft together.

A cutting counterpart B′ is carried by base means 10 having a complementary cutting surface 48 against which the blade element B strikes during cutting.

A cutting support 50 is carried by the base means 10 by means of a recess 52 formed in the base block and a threaded bolt 54 which extends into the cutting base 50 securing same in the recess 52. The cutting support includes means for attaching counterpart B′ in the form of a dovetail groove 56 which receives cutting counterpart B′ which is identical to the cutting blade element B carried by the blade clamp 38. A top surface of the element provides the complementary cutting surface 48. A gap 57 in the groove defines opposing groove jaws. There is a clamp screw 58 for closing the dovetail groove 56 and jaws upon the cutting element B to firmly hold it in place.

It is particularly important that the groove 56 be shaped so as to have converging walls at 56*a* so as to retain the counterpart B′ in use. Otherwise, the tendency of the cutting counterpart element to raise up during repeated cutting operations would cause loosening of the element B′ and possible dislodgement as well as wear of its cutting edges due to loose fitting. In this manner, the counterpart element B′ is clamped by the converging walls 56*a* such that the cutting edges 62 of the element are preserved intact for cutting operations.

The cutting element B, as can best be seen in FIG. 5 includes a quadrilateral element which has generally square configuration providing four cutting edges 62. It has been found that carbide inserts such as used in metalworking provide good cutting elements for cutting fabric on shuttleless weaving looms. This has been found to be particularly true of heavy fabrics such as fiberglass. The cutting elements referred to as B are commonly referred to in the metalworking trade as positive rake carbide inserts. A suitable insert is manufactured by The Carmet Co. of Spartanburg, S.C. as part no. HA-422SPG.

The cutting element 64 may be positioned in the blade clamp with cutting edge 62 exposed for cutting. An identical cutting element 66 is carried in the groove 56 of the cutting support. Thus, the carbide surfaces of the two elements will contact one another during cutting. When the edge 62 of element 64 becomes dull, the element 64 may be taken out of the clamp 38 and turned to another of its edges 62. After utilization of the four cutting edges of the element 64, it may be interchanged with the element 66 and the four cutting edges of the element 66 utilized as the cutting edge.

Thus, it can be seen that a highly advantageous form of the invention is provided wherein eight cutting edges are provided. As compared to conventional cutting devices which have a cutting life of only two to three months, it has been found that the present invention will last up to two years without need of new blades. The carbide inserts B, B′ have had their intersecting cutting edges rounded off at 68 so as not to catch the fabric as it is passing between the cutting blade element B and counterpart element B′. Since fiberglass and the like heavy fabrics could easily catch on a sharp edge and gather up underneath the cutting device, this is a highly advantageous expedient. Otherwise, building up of the caught fabric could occur at the cutting device necessitating loom stoppage. A smooth flush surface over which the fabric may pass for cutting without obstruction is provided by the counterpart element B′ recessed flush in groove 56.

The sides 70 of the elements B converge upwardly to complementary top cutting surface 55 and correspond to the side walls of groove 56 as well as that of blade holding recesses 40, 42 to maintain the integrity of the cutting edges of the blades. The sides 70 of cutting elements B, B′ have approximately a twelve degree slope from the cutting edge 62 to the top edge 72. The converging walls 70 bears most of the force when clamped in the cutting base 50 such that the edge 62 is maintained.

FIG. 4A shows the cutting element 64 in a raised position which corresponds to position 28*a* and 32*a* of the pivoting arm 28 and reed 32, respectively. Once the reed moves to the beat-up position as shown as 32*b*, the arm 28*b* drops as does the cutting blade 62 as can best be seen in FIG. 4B.

A roller guide 80 provides a means of guiding the waste tape 82 cut from the selvage into a waste container.

While a preferred embodiment of the invention has been described using specific terms, such description is for illustrative purposes only, and it is to be understood that changes and variations may be made without departing from the spirit or scope of the following claims.

What is claimed is:

1. A weft yarn cutting device for cutting a waste tape of fabric along a selvage of the fabric which is being woven on a loom comprising:

a base means;

clamp means for clamping said base means to said loom;

a blade carrier assembly carried by said base means;

a cutting blade element for cutting said fabric;

blade holding means carried adjacent one end of said blade carrier assembly for removably affixing said cutting blade element to said blade carrier assembly;

said blade element including a plurality of interchangeable cutting edges which may be individually selected and held by said blade holding means in a cutting position so that said cutting edges of said blade element may be interchanged on said blade carrier assembly for replacement of a dull edge;

a cutting counterpart carried by said base means having a complementary cutting surface over which said fabric passes for cutting, said cutting edge which is held by said blade holding means in said cutting position striking said complementary cutting surface to facilitate said cutting; and means for imparting a reciprocating cutting motion to said blade element against said cutting surface to cut said fabric therebetween.

2. The device of claim 1 wherein said counterpart cutting surface is a generally flat dull surface against which said blade element cuts.

3. The device of claim 1 including a cutting support means carried by said base means, said cutting counterpart including a second blade attached to said support means, attachment means for removably attaching said second blade element to said support means, said second blade element being generally identical with said first mentioned blade element, and said second and first blade elements being interchangeable with one another in said attachment means and said blade holding means so that said elements may be interchangeably utilized as a cutting blade element or a complementary cutting surface.

4. The device of claim 1 wherein said cutting blade element includes a quadrilateral blade element having four cutting edges.

5. The device of claim 3 wherein said first and second blade elements include a quadrilateral blade element having four cutting edges.

6. The device of claim 5 wherein said quadrilateral cutting element has a trapezoidal cross-section defined by inwardly tapered walls converging from said cutting edges upwardly to a top surface, said top surface providing said complementary cutting surface against which said other blade element cuts.

7. The device of claim 3 wherein said first and second blade elements include blade elements having four sides, said sides providing said cutting edges.

8. The device of claim 7 wherein said blade elements are generally square and include sides converging from said cutting edges upwardly to a top surface which provides said complementary cutting surface.

9. The device of claim 8 wherein said attachment means includes a dovetail groove, said dovetail groove having upwardly converging walls corresponding to said converging walls of said blade element which interlock therewith.

10. The device of claim 9 wherein said attachment means includes wedge means for tightening said walls together.

11. The device of claim 10 wherein said wedge means includes a gap in a bottom of said dovetail groove defining two separated groove jaws, and means for urging said jaws and said converging walls together.

12. The device of claims 4 or 5 wherein intersecting corners of said cutting edges are rounded off to prevent catching of said fabric.

13. In a shuttleless loom of the type which includes a weft insertion device for inserting picks of a weft yarn through a shed formed in a plurality of warp yarns across the fabric width, an oscillating reed for beating up said weft yarn into said fabric, said warp yarns including a number of excess warp yarns woven on a selvage of said fabric opposite said weft insertion device for holding said weft yarn picks upon insertion, a weft cutting device carried by said loom for cutting off a waste tape of fabric as woven by said excess warp yarns and said weft yarn picks, a base means adapted for mounting said cutting device to said loom adjacent said selvage, said cutting device including a cutting blade element carried by said base means, a pivoting arm mechanism carried by said base means operated by said reed as it oscillates during beat-up of said fabric imparting a cutting motion to said blade element, wherein said cutting device comprises:

said cutting blade element including a multi-sided cutting element having a plurality of cutting edges each of which is effective for cutting said waste tapes;

blade carrier means for holding said blade element so that any one of said cutting edges may be individually selected and held in a cutting position for cutting said waste tape and fabric as needed for replacement of a dull cutting edge; and a cutting counterpart carried by said base means in a second cutting position having a complementary cutting surface against which said cutting blade element strikes during cutting facilitating cutting of said fabric.

14. The device of claim 13 wherein said cutting counterpart includes a second multi-sided blade element being substantially identical to said first mentioned multi-sided blade element, said first and second blade elements being interchangeably held and mounted in said first mentioned and second cutting position on said base means.

15. The device of claim 13 or 14 wherein said blade element is generally square and includes four cutting edges, and converging sides tapering inwardly from said cutting edges to a top complementary cutting surface defining a generally trapezoidal cross-section.

16. The device of claim 5 wherein intersections of said cutting edges are rounded off to avoid catching on said fabric.

* * * * *